United States Patent [19]

Benasutti et al.

[11] 3,949,903

[45] Apr. 13, 1976

[54] WATER AND BEVERAGE CONCENTRATE DISPENSER

[75] Inventors: Louis D. Benasutti, Fairborn; Jost S. Sucro, Dayton, both of Ohio

[73] Assignee: General Motors Corporation, Detroit, Mich.

[22] Filed: Sept. 12, 1974

[21] Appl. No.: 505,452

Related U.S. Application Data

[63] Continuation-in-part of Ser. No. 413,691, Nov. 7, 1973, abandoned.

[52] U.S. Cl. ..... 222/129.2; 222/509

[51] Int. Cl.[2] ..... B67D 5/56

[58] Field of Search .... 222/57, 129.1, 129.2, 129.3, 222/129.4, 133, 193, 505, 509; 137/604, 613, 614.11; 239/318; 417/167, 174; 261/DIG. 7, DIG. 77, 75, 76, 77; 259/4

[56] References Cited

UNITED STATES PATENTS

| | | | |
|---|---|---|---|
| 3,007,609 | 11/1961 | Pascucci | 222/129.2 |
| 3,223,121 | 12/1965 | Lee | 259/4 X |
| 3,357,598 | 12/1967 | Kraft | 222/193 X |
| 3,643,688 | 2/1972 | Meinert | 222/129.2 X |
| 3,756,473 | 9/1973 | Donahue | 222/129.2 |

*Primary Examiner*—Robert B. Reeves
*Assistant Examiner*—Joseph J. Rolla
*Attorney, Agent, or Firm*—Edward P. Barthel

[57] ABSTRACT

A beverage concentrate and water dispenser for a household refrigerator cabinet wherein multiple spouts with individual actuating and mixture diluting means are accessible from the exterior of the refrigerator cabinet. The dispenser includes a plurality of valves, fed with chilled water via a manifold from a water storage tank within the cabinet, for flow through jet nozzle aspirator means, operative for drawing beverage concentrate through a suction tube for mixing with the water prior to being dispensed. The dispenser concentrate-water mixture diluting means includes a valve in a water bypass passageway for selecting the proportion of bypass water dilution desired to be added to the concentrate-water mixture. An electrical switch is operative in sequence with resiliently biased valve plug members to delay the admission of source water under line or water main pressure into the manifold until the selected valve plug has been unseated.

6 Claims, 16 Drawing Figures

WATER AND BEVERAGE CONCENTRATE DISPENSER

This application is a continuation-in-part of our copending application Ser. No. 413,691,filed Nov. 7, 1973, entitled "Water and Beverage Concentrate Dispenser", now abandoned.

This invention relates to a beverage concentrate and chilled water dispenser and particularly to a dispenser for use with a household refrigerator cabinet accessible for selectively discharging cooled water together with one or more beverage concentrate-water mixtures from the fresh food compartment of the refrigerator cabinet.

The prior art is replete with systems for dispensing cooling liquids from a refrigerator cabinet. An example is the refrigerating apparatus for cooling liquids disclosed in U.S. Pat. No. 2,786,338 issued Mar. 26, 1957, to Clifford H. Wurtz, et al. The Wurtz et al patent discloses a dispenser having a manually actuated selector which may be set to discharge chilled water alone or a mixture of water and beverage concentrate from a single spout when the refrigerator door is opened. The Wurtz patent discloses a dispenser that incorporates a Venturi device effective for creating a suction sufficient to unseat a ball check valve and draw concentrated fruit juice upwardly in a tube from a supply container and to discharge the same into a passageway where it is mixed with chilled water flowing therethrough for dispensing into a drinking cup or container when the refrigerator door is opened.

It is an object of the present invention to provide a dispenser for a refrigerator cabinet for discharging a mixture of chilled water and beverage concentrate wherein primary and secondary jet nozzles are in partially telescoped spaced coaxial relation effective for creating first and second mixing stages by drawing via suction beverage concentrate from a radial feed tube into an initial mixing stage within the secondary nozzle and a final mixing stage located where the exit orifice of the downstream secondary nozzle partially telescopes into a throat portion of a dispensing spout passageway.

It is another object of the present invention to provide a water and multiple beverage concentrate dispenser assembly for a refrigerator cabinet having a water cooling storage tank within the cabinet wherein each of a plurality of dispensers is provided with individual valve sequencing dispensing actuators operative to initially unseat the associated valve plug of the selected dispenser actuator after which a common electrical switch means is actuated for opening line water valve means interposed in the connection between the storage tank and the source of household water supply to insure against a surge of line or water main pressure being delivered to the actuated dispenser valve prior to its valve plug being unseated.

It is still another object of the invention to provide individual beverage concentrate-water mixing control means allowing the operator to select the degree of downstream bypass water dilution that will be added to a constant relatively rich beverage concentrate-water mix achieved by jet aspirator means just prior to the mix leaving the mixing passage for flow into a downwardly directed exit spout wherein the mixing water and bypass water are taken from a common constant pressure chamber of the water control valve.

Yet another object of the invention is to provide a refrigerator cabinet dispenser for discharging a preset mixture of chilled water and beverage concentrate wherein a valve casing includes at least one valve chamber having an inlet connected to a source of water supply under pressure, the valve chamber having a first exit passage extending forwardly from the valve chamber terminating in a reduced nozzle, the outlet of the nozzle extending into a jet aspirator cavity, a vertical beverage concentrate feed tube in communication with the underside of the cavity, the nozzle outlet being coaxial with and axially spaced from a diverging tubular mixing section of the jet nozzle having an entrance downstream converging cone portion communicating with the cavity, the mixing section having an extended cone downstream diverging cone portion, the mixing section terminating in a spout member directing the beverage concentrate-water mixture downwardly for dispensing into a receptacle, water bypass passage means extending from a second exit in the valve chamber, a transverse tubular passage connecting the bypass passage at the downstream end of the diverging mixing section, and valve means in the bypass passageway operative when opened to add selected amounts of dilution bypass water to the constant ratio of beverage concentrate to water mixture achieved by the jet nozzle aspirator in the mixing section.

Further objects and advantages of the present invention will be apparent from the following description, reference being had to the accompanying drawings wherein a preferred form of the invention is clearly shown.

Figure 3:
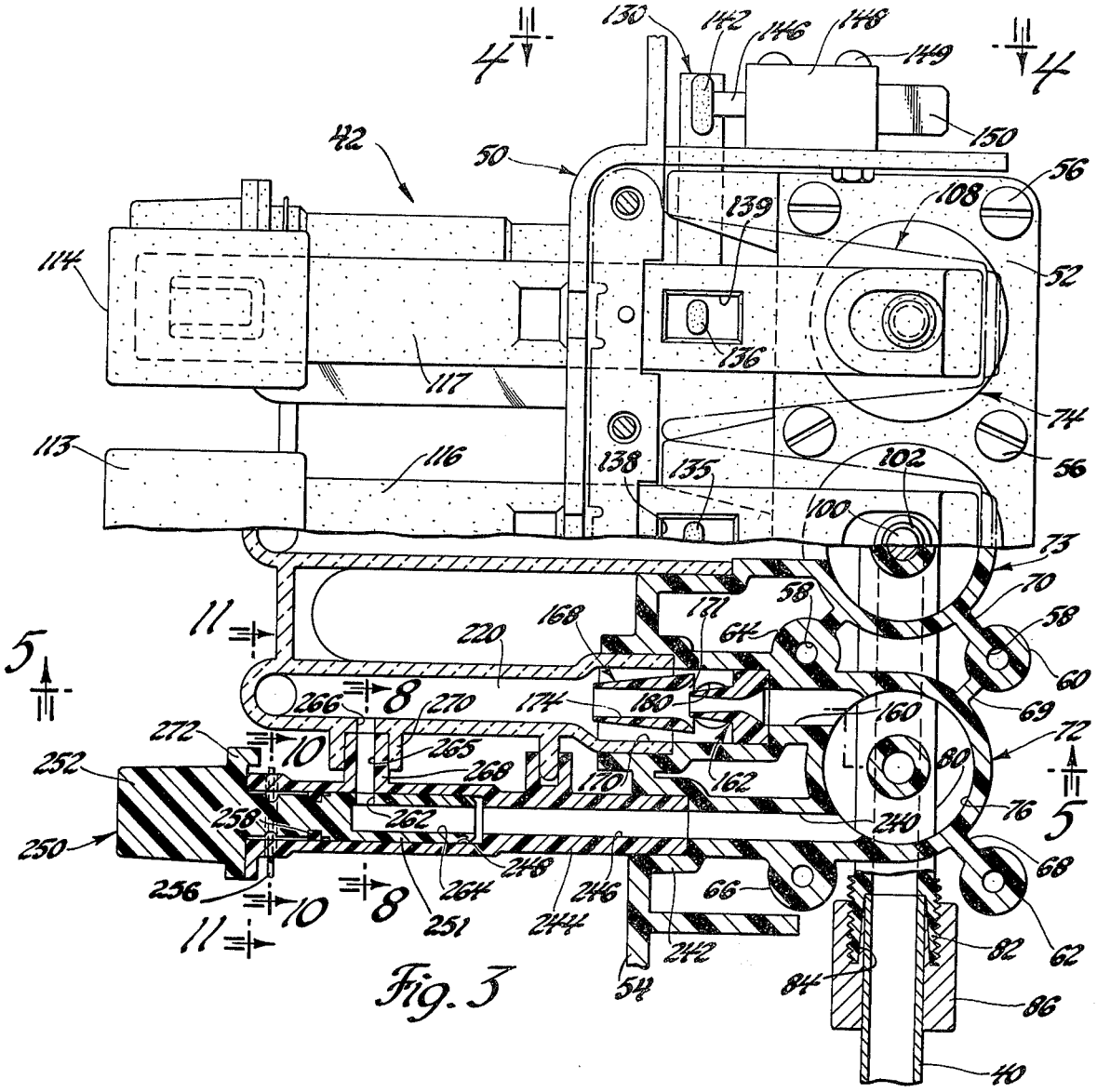
FIG. 3 is a horizontal elevational view, partly in section of the dispenser.
Figure 10:
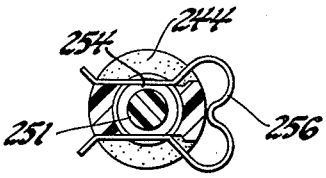
Figure 11:
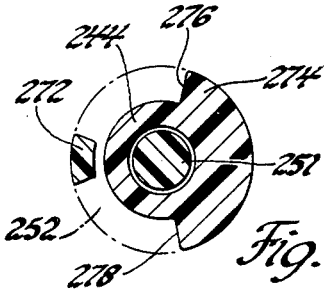
Figure 12:
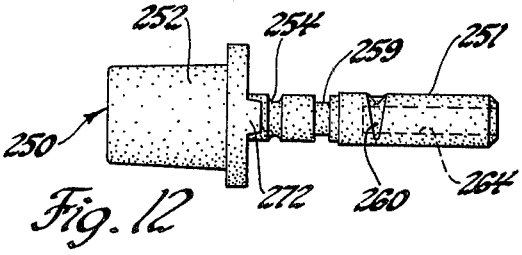

FIGS. 10 and 11 are enlarged fragmentary sectional views taken on the lines 10—10 and 11—11 of FIG. 3;

FIG. 12 is an enlarged elevational view of the ratio control.

Figure 13:
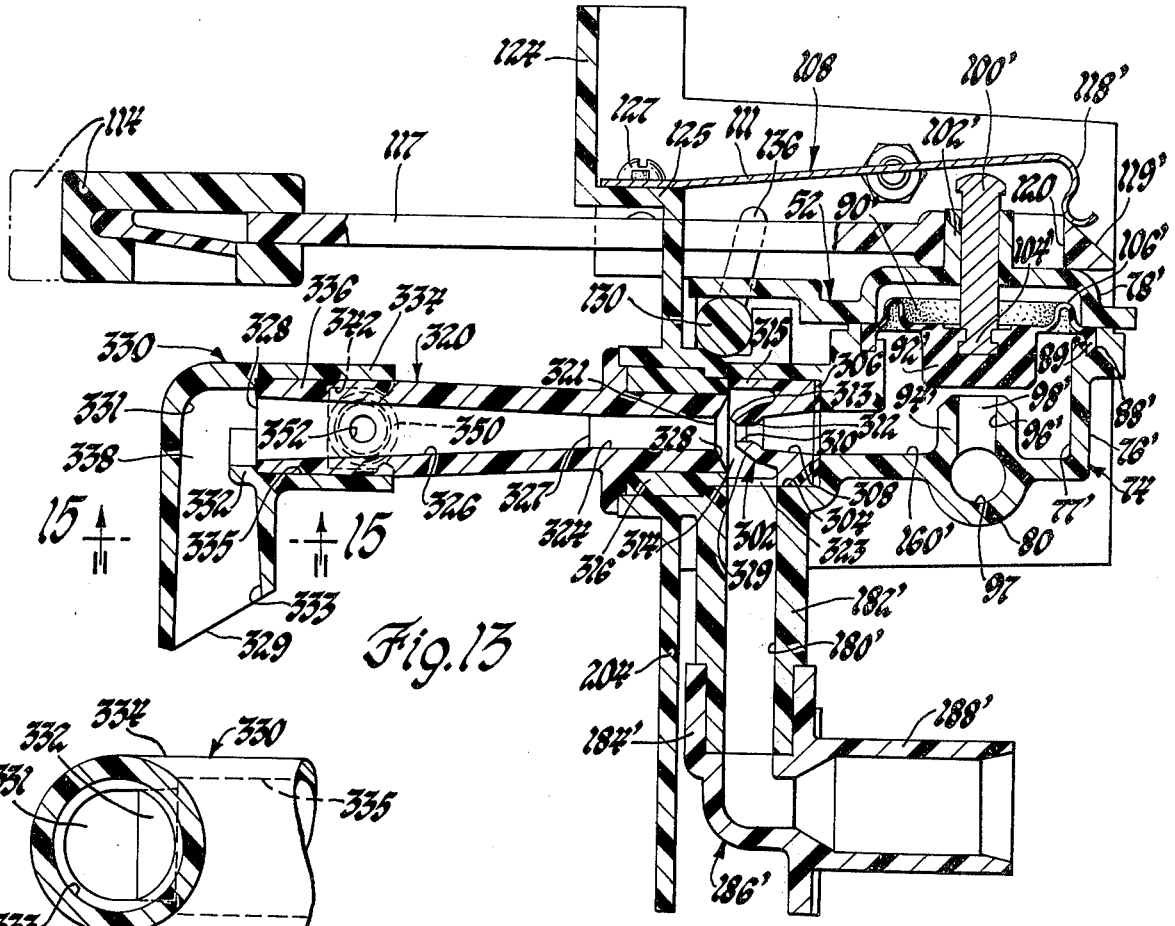
Figure 15:
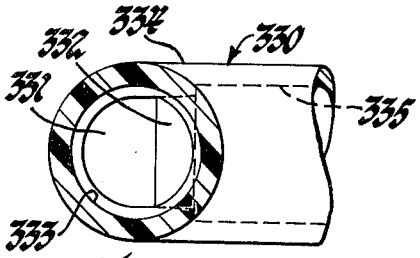
Figure 14:
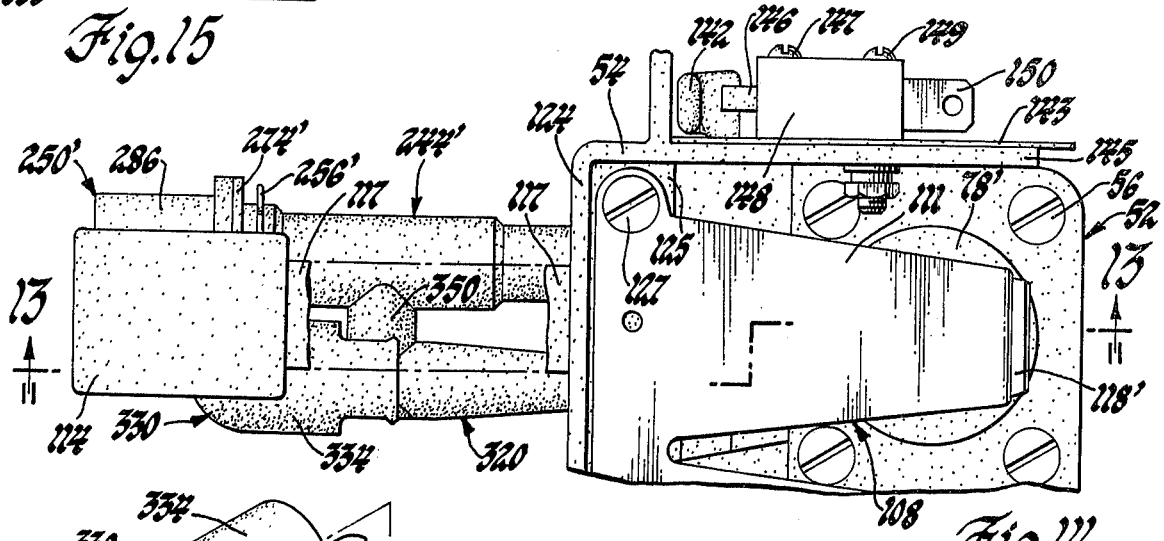
Figure 16:
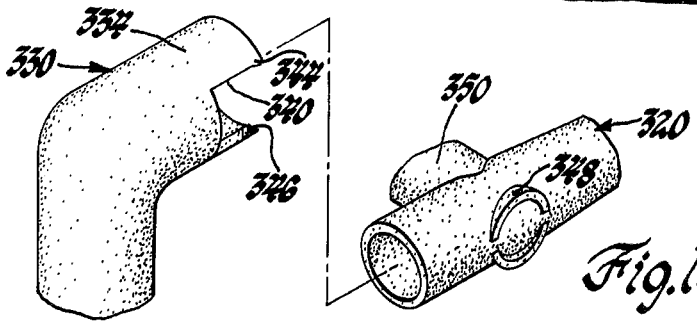

FIG. 13 is a vertical sectional view taken substantially along line 13—13 of a modified dispenser assembly shown in FIG. 14 with the valve in open position;

FIG. 14 is a fragmentary horizontal elevational view of a modified dispenser assembly showing only the left hand dispenser;

FIG. 15 is an enlarged fragmentary sectional view taken along the line 15—15 of FIG. 13;

FIG. 16 is an exploded view of the dispenser nozzle shown in FIG. 15.

Figure 1:
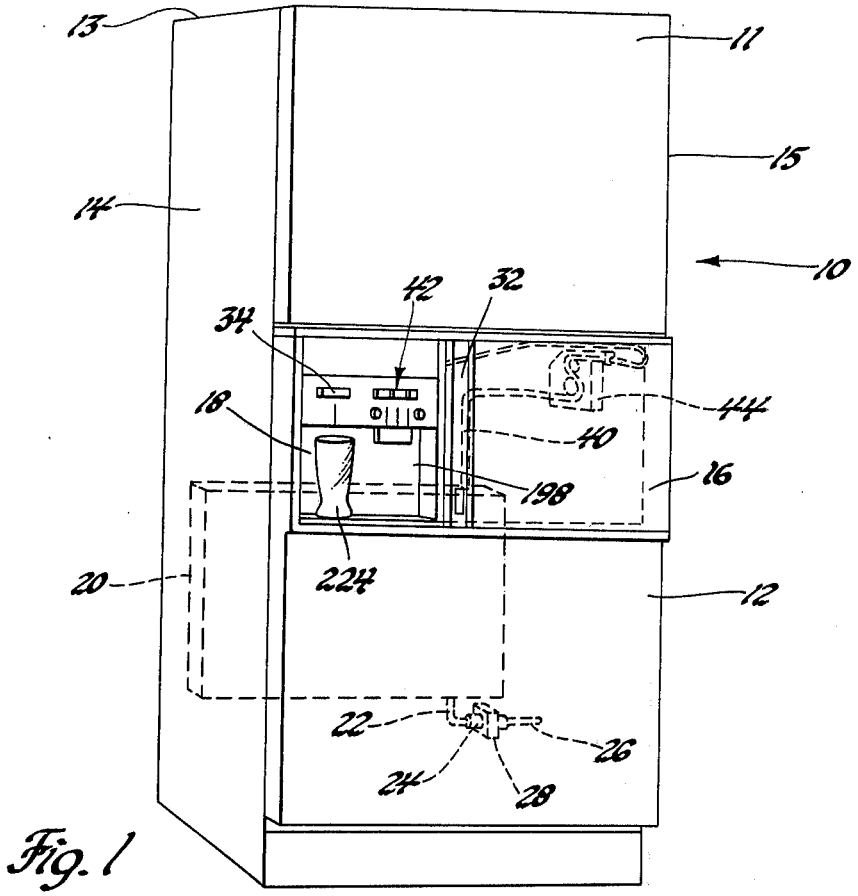
FIG. 1 is a perspective view of a refrigerator cabinet incorporating the present invention.

Referring now to the drawings, there is shown in FIG. 1 a refrigerator cabinet 10 having upper freezer compartment closed by an upper door 11 and lower fresh food compartment closed by a lower door 12. The cabinet includes an insulated top outer wall 13, insulated side walls 14 and 15. The lower door 12 includes an outer sheet metal panel 16 having a combined ice cube, water and juice service area 18 provided in the face of the door. The ice cube dispensing portion of the service area is shown and described in copending U.S. Pat. application Ser. No. 309,935, now U.S. Pat. No. 3,789,620, assigned to the assignee of the instant application.

As seen in FIG. 1, a water cooling receptacle or tank 20 for supplying chilled water to the service area 18 is positioned in the rear portion of the fresh food compartment and has an inlet tube 22 connected via solenoid operated line valve 24 to a conventional household water supply line 26. The control valve 24 is preferably located in the machine compartment of the refrigerator and is actuated in response to the energization and deenergization of an electric solenoid 28 associated therewith. The water tank 20 is exposed to above-freezing temperatures within the food compartment so that it is maintained in a chilled condition thereby. The service area 18 may be closed by a sliding door partially indicated at 32 so as to conceal the ice cube actuator 34 and beverage dispenser to be described.

In the preferred form a length of tubing or flexible water line 40 connects the cold water tank 20 to a manually actuated water and beverage concentrate dispenser assembly 42 positioned in the lower door 12, the dispensing spouts of which extend into the service area 18. Suitable means to allow for the extension and retraction of the flexible water line 40 into and out of the door 12 may be provided such as the retractor 44 disclosed in the copending U.S. Pat. application Ser. No. 311,309, now U.S. Pat. 3,788,094, assigned to the assignee of the instant application.

With reference to FIGS. 3, 4, 5 and 6, the beverage concentrate and water dispenser 42 includes a valve casing 50 preferably molded of a suitable plastic material formed by an upper valve cover plate 52 and a lower valve housing 54 secured by suitable means such as fasteners 56 threadably received in holes 58 in rear molded bosses shown at 60 and 62 and front bosses shown at 64 and 66. The rear bosses 60 and 62 have radial web portions exemplified at 68, 69 and 70 integrally molded with a plurality of spaced chilled water control or discharge valves which in the preferred form are three in number indicated generally at 72, 73 and 74, with the left hand 74 and right hand 72 valves operative for controlling the mixing water used in discharging beverage concentrates and the center valve 73 operative for controlling the discharge of chilled water from the dispenser. As the three discharge valves are identical in structure only the right hand valve 72 will be described in detail in the first embodiment of the invention.

The valve 72 includes a lower cylindrical valve cup 76 having a circular valve chamber 77 and an upper cylindrical dome 78 molded in cover plate 52. Each of the cups of the valves 72, 73 and 74 are interconnected by a water supply pipe or manifold 80 integrally molded in the bottom walls of the valve cups so as to be transversely aligned on the valve centers and whose inlet end 82 projects outwardly from valve cup 76 for reception of the water line 40 in the counterbored portion 84 of the pipe. The inlet end 82 is threaded for the reception of hex lock nut 86 to set the water tube in a water-tight sealed manner.

Figure 5:
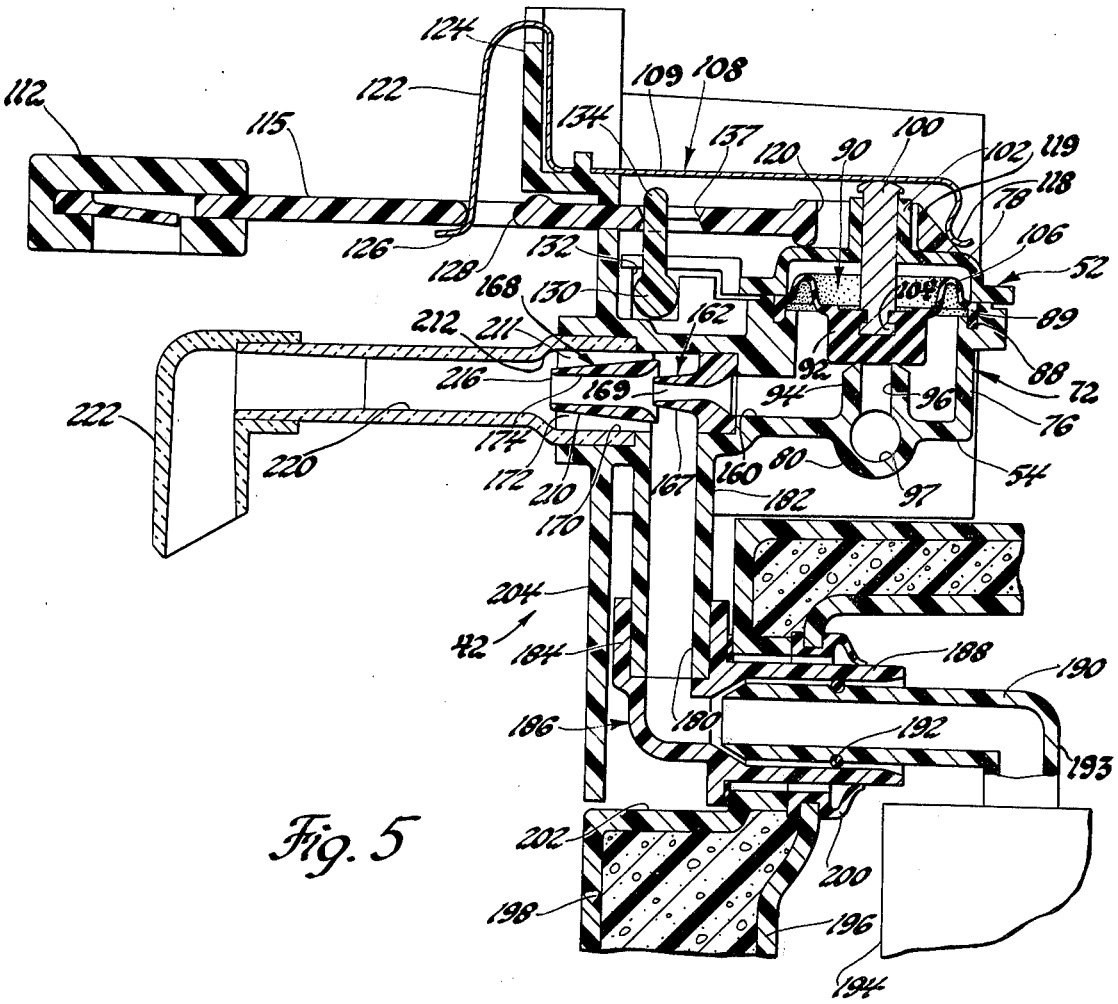
FIG. 5 is a vertical sectional view taken substantially along line 5—5 of FIG. 3 with the valve in closed position.

As seen in FIG. 5, the upper periphery of the cup 76 has a circular concentric groove 88 for reception of sealing ring portion 89 of a flexible bellows valve plug member generally indicated at 90 including a valve disc 92 which seats on an upwardly extending valve stem portion 94 of the valve 72 provided with a bore 96, the lower end of which is in communication with the passage 97 of water pipe 80.

An actuating pin 100 is designed for vertical reciprocation in cylinder 102, integrally molded on the valve dome 78, while the pin 100 is affixed to the valve disc 92 by pin detent 104 retained in an undercut socket of the disc 92. The valve plug member 90 includes a concentric resilient bellows 106 which biases the valve disc 92 to a raised unseated position shown in FIG. 6. As seen in FIG. 7, a plate-type valve actuator spring 108, having three rearwardly extending prongs 109, 110 and 111, has its first spring prong 109 flexed to an upwardly and rearwardly canted position resulting from inward pressure by the operator on right-hand valve actuator push button 112 accessible from the serving area 18 together with center cold water button 113 and left hand button 114 for moving operating slides 115, 116 and 117, respectively. The prong-shaped leaf spring 109 has its reduced end provided with an S-shaped or reverse curved cam follower 118 which is in resilient contact with the slide's wedged or cammed end surface 119. Thus, the slide 115, formed with a guide slot 120 for receiving valve cylinder 102 therein, is operative upon initial inward movement to flex prong 109 upwardly, by means of cam follower 118 being vertically cammed by wedge 119, thereby allowing the resilient upwardly biased bellows 106 to flex upwardly resulting in the immediate unseating of valve disc 92 from valve stem 94. It will be noted that the integral C-shaped return spring portion 122 of the plate spring 108 bridges the service area rear wall 124 with its hooked end 126 being received in slide aperture 128 such that supon release of pressure on button 112 the spring 112 assists the leaf spring 109 and its cam follower 118 in returning the actuator slide 115 to its outwardly biased position of FIG. 5.

Figure 6:
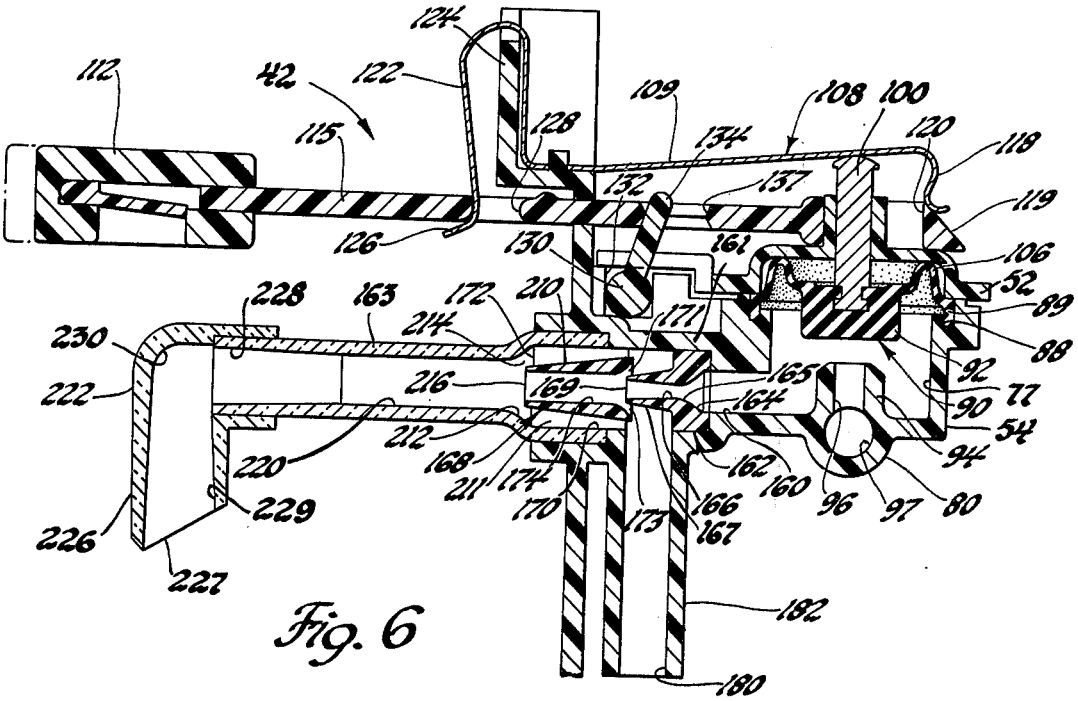
FIG. 6 is a view similar to FIG. 5 showing the valve in its open position.
Figure 7:
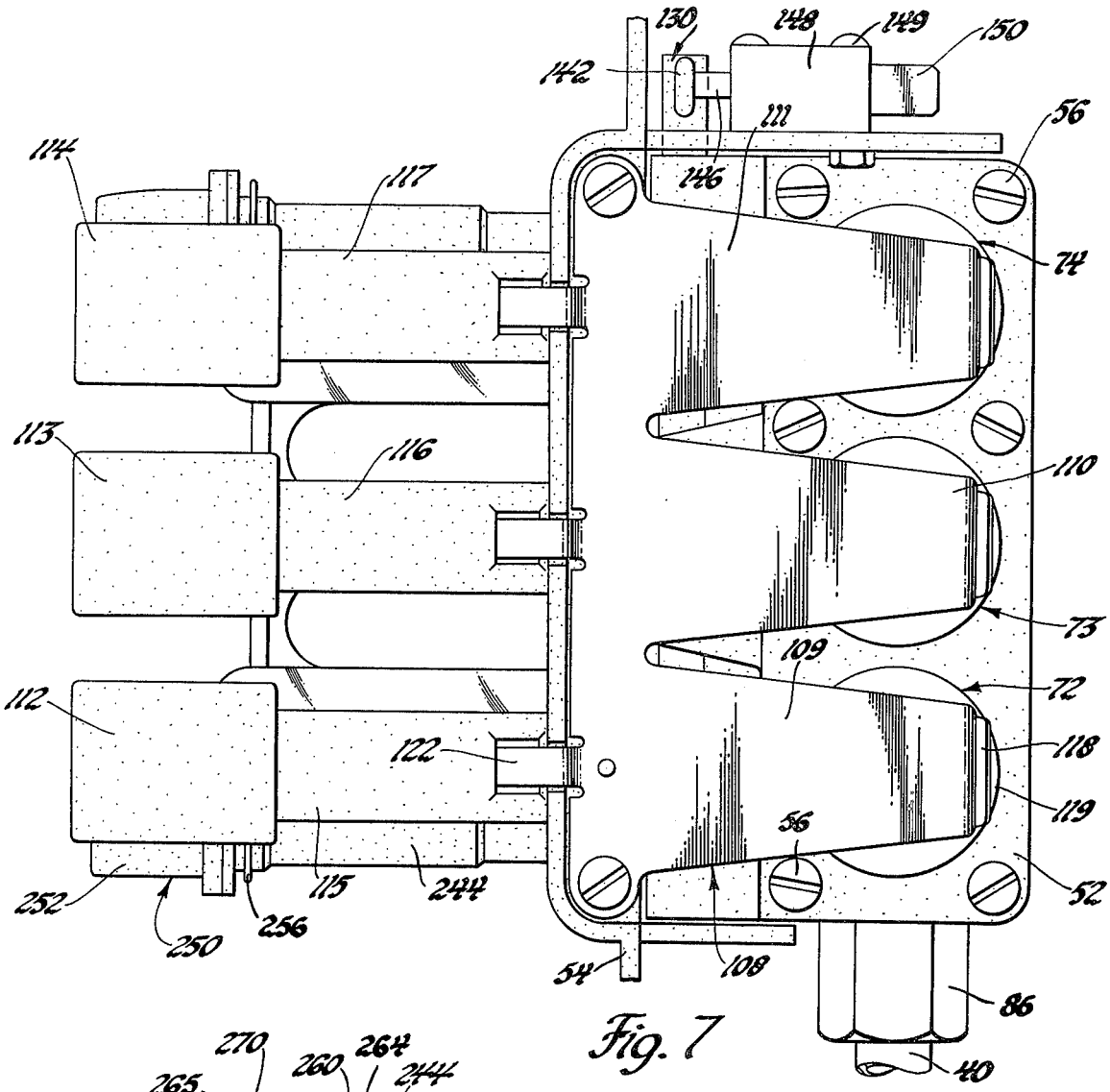
FIG. 7 is a top elevational view of the dispenser.

As seen in FIG. 3, a switch actuating shaft 130 extends transversely across the dispenser for pivotal movement in spaced notched portions, one of which is indicated at 132 in FIGS. 5 and 6, formed in the housing 76. The actuating shaft 130 is formed with three spaced upstanding tabs 134, 135 and 136 each of which extends into and through its associated aligned rectangular openings 137, 138 and 139 located in valve actuator slides 115, 116 and 117, respectively. The shaft 130 includes an end finger 142 positioned at the left hand end of the valve casing 50 adjacent actuating probe 146 of switch means in the form of a microswitch 148 (FIG. 4) secured to the casing as by screws 149.

Figure 4:
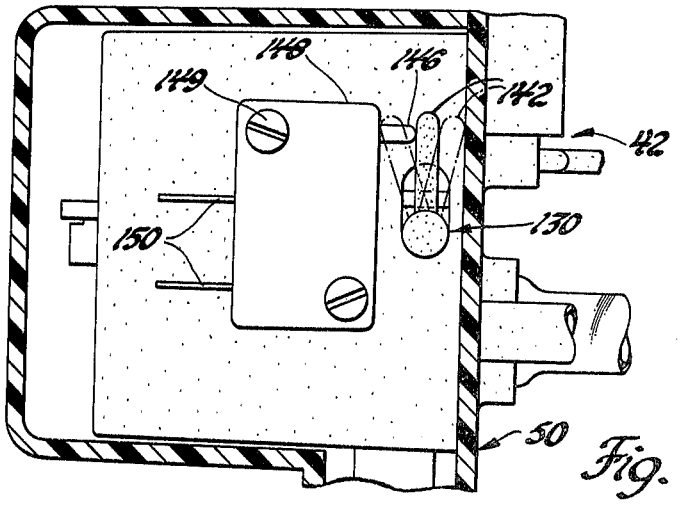
FIG. 4 is a side elevational view, partly in section, taken on line 4—4 of FIG. 3.

As best seen in FIG. 5, the valve slide 115 has its opening 137 located relative to its associated tab 134 such that the tab 134 is engaged and pivoted upon continued inward pressure on button 112 to cause clockwise rotational movement of the shaft 132 and its end finger 142 to its phantom line position in FIG. 4 whereby the switch probe 146 is depressed, closing the contacts of microswitch 148 and via conductors (not shown) connected from microswitch prongs 150 so as to energize the solenoid 28 resulting in opening the water line valve 24 to initiate the smooth flow of line-pressure water in pipe 26 from passage 97 and bore 96 via the open valve into the valve chamber 77 of cup 76.

Thus, water is fed from chamber 77 through a first nozzle tangent passage 160 into a mixing tube 161 enclosing a primary axially aligned Venturi nozzle 162 having a smooth continuous curve from its relatively short entrance converging cone 164 and throat 165 to its relatively long exit diverging cone 166. The primary nozzle 162 has the downstream forward portion of its outer peripheral surface 167 reduced in diameter relative to the mixing tube bore 170 and generated in the shape of a forwardly convergent cone converging toward its downstream exit orifice 169 to provide a first stage concentrate aspirator or suction annular region 171 in conjunction with a secondary nozzle to be described.

A secondary straight jet nozzle generally indicated at 168 is aligned on the axis of the primary Venturi nozzle 162 in the cylindrical passageway or bore 170 formed by mixing tube 161 and intermediate tube 163 by means of a plurality of longitudinally extending radial fins 172 which fixedly position the secondary jet nozzle 168 concentrically within the bore 170. The secondary nozzle 168 has its inner surface formed with a converging cone-shaped entrance orifice 173 to its relatively long cylindrical passage 174 providing a first stage concentrate-water mixing passage. It will be noted that the forward end orifice 169 of the primary nozzle 162 is inserted or telescoped in spaced relation a defined distance within the entrance orifice 173 of the secondary forward nozzle 168 and that the annular area of insertion defines the first stage concentrate aspirator region 171 in communication with radial suction paassgeway 180 of vertical beverage concentrate feed tube 182.

As seen in FIG. 5 the feed tube 182 is fitted within upwardly directed enlarged end 184 of a 90° elbow connection 186 while the rearwardly extending enlarged connector inlet end 188 has removably inserted therein the horizontal portion of beverage concentrate siphon tube 190 which is suitably sealed as by O-ring 192. The tube 190 is formed with a 90° bend for sealed insertion of its vertical portion 193 in a suitable beverage concentrate container partially indicated at 194 in FIG. 4. The concentrate in container 194 is thus maintained at the temperature of the above-freezing compartment of the refrigerator 10 by being supported on shelf means (not shown) formed on the liner portion 196 of the service area insulated rear wall 198 shown in FIG. 5. To insure against the passage of room air therethrough, sealing means in the form of resilient seal 200 is provided between the wall opening 202, closed by cover plate 204, and the molded feed tube 190.

The secondary jet nozzle 168 has its outer peripheral surface 210 generated in the shape of a cone converging toward its downstream exit orifice 216 so as together with the cylindrical wall of the enlarged bore 170 defining an annular channel in the form of one-half of a cone section or space 211 and is adapted to cooperate with the adjacent convergent cone or throat portion 212 of enlarged bore 170 providing a second stage concentrate aspirator or suction annular region 214 which is also in communication with the radial suction passageway 180 via one-half cone-shaped channel 211.

In operation when the water exiting the forward orifice 176 of the primary Venturi nozzle 162 is discharged into the entrance 178 of the downstream secondary jet nozzle 168 a defined suction is developed in the first stage aspirator area 171 to draw beverage concentrate from the container 194 through the suction passageway 180 and into the first stage mixing passage 174 of the secondary nozzle 168 for an initial water concentrate mixture which is discharged from the exit orifice 216 of the secondary jet nozzle 168. Upon the discharge of the primary mix from the exit orifice 216 a suction is developed by the second stage aspirator region 214 which draws concentrate from the suction passageway 180 into the annular one-half cone channel 211 for second stage mixing in the cylindrical passage 220 to provide a dual-stage beverage concentrate dispenser. Tests of the dispenser show that in addition to the first and second stage mixing achieved with applicant's design a blender-like recirculation of the first stage water-concentrate mixture. This occurs because of a reverse flow of a portion of the first stage mixture exiting orifice 216 for recirculation in an upstream direction on the outer surface 210 of the jet nozzle 168 whereby it is drawn back into the entrance orifice 173 for blending with the first stage mixing passage 174.

A right-angle spout member 222 has its upstream end 223 removably coupled on the downstream end of the intermediate tube 163 such that the downwardly directed spout 226 has its orifice 227 positioned for dispensing the beverage concentrate into a suitable container placed below such as glass 224 shown positioned in service area 198 in FIG. 2. It will be noted that the cylindrical passage 220 has its downstream portion 228 formed into a diverging cone which is shaped to lead into diverging cone portion 229 of spout 226 via connecting elbow passage 230. Because of the diverging cone configurations 228 and 229, which in the disclosed form are flared at an angle of about 3°, applicant's dispenser provides for increased smooth flow from the spout orifice 227 which results in increased suction being achieved in the aspirator regions 171 and 214.

As best seen in FIG. 3 a longitudinal water bypass passageway 240 is provided in the dispenser parallel with the nozzle passage 160 connecting into the valve cup 76 at a common water pressure source or chamber 77 with the passage 160 and having a counterbored enlarged portion 242 forming a junction for seating a bypass water dilution control tube 244 provided with an aligned passageway 246. The outer end of the tube 244 is enlarged and has a countersunk bore 248 for telescopic reception of ratio control member 250 including an inner stem 251 received in the bore 248 and an outer ratio control knob 252 for rotation of the stem 250 relative to the dilution control tube 244. As viewed in FIG. 10 the control stem has an outer annular groove 254 for retention of a retainer spring 256 therein. An O-ring seal 258 is provided in the stem groove 259 for sealing bore 248.

Figure 8:
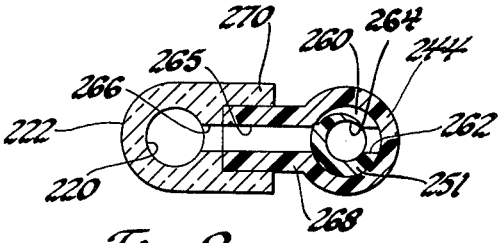
FIG. 8 is an enlarged fragmentary sectional view taken on line 8—8 of FIG. 2 showing the bypass closed.
Figure 9:
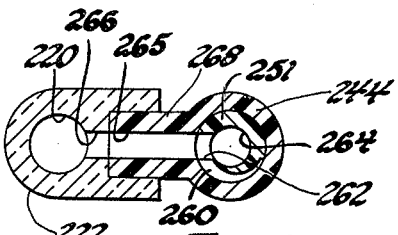
FIG. 9 is a view similar to FIG. 8 showing the bypass in open position.

As best seen in FIG. 12, an annular tapered V-sectioned groove 260, being crescent-shaped in transverse section, is formed in the outer surface of the stem 251 having at its maximum axial width portion a radial bore 262 (FIGS. 8 and 9) formed therein communicating with ratio control axial passage 264. Thus, as the knob 252 of the ratio control stem is turned in a counterclockwise direction from its water bypass closed RICH position in FIG. 8 the narrow end of V-sectioned groove 260 is brought into communication with the radial bore 262 allowing a small quantity of diluting water to be drawn through transverse passage 265, aligned with opening 266 by virtue of transverse stem 268 being received in boss 270, to mix with the water-concentrate mixture flowing through outlet passageway 220. Upon further counterclockwise movement of knob 252 the amount of diluting water flowing through passage 264 increases until the stem reaches the position shown in FIG. 9 wherein the stem bore 262 is located in concentric fashion with the passage 264 to allow maximum flow of bypass diluting water therethrough to achieve a MILD water-concentrate mix.

As seen in FIG. 11 the inner face of knob 252 has a lug 272 formed thereon for engagement with the free edges of fixed crescent-shaped disc 274 formed on the ratio control tube 244. In this manner when the lug 272 engages disc edge 276 the stem 251 is in its fully closed RICH position of FIG. 8 and when the lug 272 engages disc edge 278 the stem 251 is in its fully open MILD position of FIG. 9.

Figure 2:
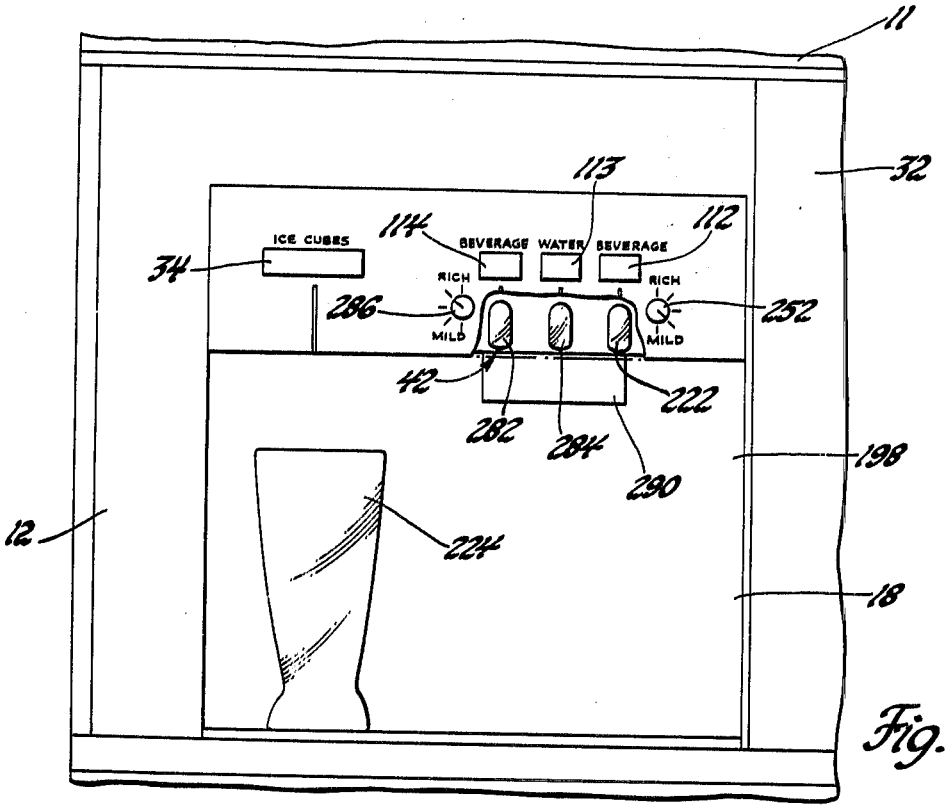
FIG. 2 is an enlarged fragmentary front view of the door service area.

It will be noted that a left hand ratio control member is provided for the left hand dispenser unit whose spout 282 is shown in FIG. 2 adjacent the center chilled water dispensing spout 284. The left hand ratio control member is of identical construction and function in reverse relation to that of the right hand ratio control member. That is, the left hand ratio control knob 286 is rotated in a clockwise direction to change from a MILD to RICH beverage concentrate mixture, while in counterdistinction the right hand knob 252 is rotated in a counterclockwise direction to change from a MILD to RICH mixture. A glass positioning board 290 extends downwardly from the dispenser assembly to correctly align the glass beneath the selected spout.

A modified form of applicants' invention is shown in FIGS. 13–16 wherein the aspirating means is in the form of a single stage jet pump. In describing the modification of the invention illustrated in FIGS. 13–16, the same reference numerals used in the description of the embodiment illustrated in FIGS. 1–12 will be used to indicate the same parts while corresponding parts of the left hand discharge valve 74, similar to the elements of the right hand control valve of FIGS. 1–12 will be primed.

As seen in FIG. 13, the left hand beverage concentrate dispenser is shown with its button 114 and slide 117 depressed. The left hand leaf spring prong 111 of the valve actuator spring 108 is flexed to its upwardly and rearwardly canted position resulting from its narrow end portion's S-shaped or reverse curved cam follower 118' being flexed and upwardly cammed by downwardly and inwardly wedged cammed end surface 119' on the distal end of slide 117. It will be noted that the spring 108 is secured to the horizontal flange portion 125 of wall 124 by means of threaded fastener 127. This arrangement eliminates the C-shaped return spring portion 122 of the embodiment of FIGS. 1–12 and relies solely on the leaf spring prong 111 to return the actuator slide 117 to its outwardly biased position shown in FIG. 3.

The operation of the left hand control or discharge valve 74 in FIG. 13 is identical to that of the control valve 72 wherein the valve cup 76' of the valve 74 has a circular valve chamber 77' enclosed by an upper cylindrical dome 78' which is molded in cover plate 52. The transversely extending water supply pipe or manifold 80 terminates adjacent the center of the valve cup base and has an aperture communicating with the chamber 77' via bore 96' in valve stem 94'. The left hand flexible bellows valve plug 90', provided with an annular sealing ring 89' received in groove 88', has a valve disc 92' which seats on stem 94' to seal bore 96'.

The actuating pin 100'reciprocates in cylinder 102' while pin detent 104' is secured in an undercut socket of the disc 92'. The valve plug 90' has a concentric resilient bellows 106' which biases the valve disc 94' to a raised unsealed position as described in FIG. 6 for the right hand dispenser valve.

As seen in FIG. 14, the button 114 and slide 117 are shown in their normal extended position with the tab 136 (FIG. 13) of actuating shaft 130 in a generally vertical position along with end finger 142 such that the microswitch probe 146 is in its outward normally open position. It will be noted that the mounting bolts 147 and 149 are located at diagonal corners of the microswitch housing 148 with the rear upper bolt 149 extending through a slotted opening (not shown) in dispenser side wall 145 to allow for exact adjustment of the microswitch. A sheet of suitable electrical insulating material such as phenolic material as shown at 143 separates the microswitch from the plastic wall 145.

In the same manner as explained for the right hand dispenser in the embodiment of FIGS. 1–12, upon initial inward pressure on button 114 the slide 117 moves inwardly such that its wedge or cam end surface 119' flexes and moves cam follower 118' vertically, allowing the resilient upwardly biased bellows 106' to flex upwardly resulting in the immediate unseating of valve disc 94' from valve stem 94'.

Further inward pressure of slide 117 causes the forward edge of its opening 139 to engage and pivot tab 136 to its rearwardly slanted position of FIG. 13 whereby end finger 142 depresses microswitch probe 146 energizing the solenoid 28 (FIG. 1) to the open water line valve 24 and start the flow of household line-pressure water in pipe 26 from passage 97 of the water supply manifold or pipe 80 and vertical valve bore 96' via the unseated open valve inlet 98' into the valve chamber 77'.

Water thus fills the chamber 77' at a uniform household line-pressure and flows therethrough exiting via first nozzle feed passage 160' extending forwardly in a tangential manner from one side of the chamber 77' in the manner as passage 160 in FIG. 3 with the exception that valve 72 is a mirror image of valve 74. Aligned axially with passage 160' is a jet aspirator including a water ejector or nozzle member 302 seated in a concentric socket 304 and suitably sealed as by a resilient washer 306.

The ejector nozzle member 302 has an initial entrance portion in the form of a downstream converging conical tube or truncated cone passaage 308 which communicates with or feeds a reduced constant diameter cylindrical ring 310 via an intermediate inwardly curved cone portion 312. The nozzle exit 313 is located in an arcuate aspirator zone or cavity 314 defined in part by a forwardly projecting cylindrical wall 315, the forward end of which abuts the rear end face of a tubular collar adapter 316. It will be noted that wall 315 exactly gauges or positions the exit orifice 313 of the nozzle 310 a predetermined axially spaced distance from downstream converging truncated entrance cone portion 318 of a water-juice or water-beverage concentrate conducting or flow tube member generally indicated at 320.

As disclosed in the embodiment of FIGS. 1–12, a feed tube 182' is fitted within upwardly directed enlarged end 184' of a 90° elbow connection 186' with its inlet 188' having inserted therein a beverage concentrate siphon tube such as shown at 190 in FIG. 5. The vertical feed tube 182' provides a radial disposed vertical suction passageway 180' the upper end of which exits into the lower portion of the arcuate aspirator cavity 314 by means of a rounded end U-shaped slotted opening 323 formed in the lower portion of the arcuate wall 315 of the ejector nozzle 302. The water ejector 302 provides a water accelerating jet nozzle section 310 which directs a defined water jet into the water-beverage concentrate or water-juice flow tube 320. The water-juice flow tube 320 includes the entrance downstream of converging cone portion 318; which in the disclosed form intercepts an arc of about 120°, an intermediate constant diameter neck portion passage 324 and a portion 326 that flares or diverges from the neck downstream exit 327 to the mixing tube front exit orifice 328 in a downstream diverging manner. It is important to note that the conical entrance 318 is shown with a downstream sharp annular edge indicated at 321 to precisely define the entrance to neck portion 324. Further, it will be appreciated that the outer peripheral frusto-conical shaped surface 319 of the ejector 302 is forwardly tapered to intercept an arc of about 75° such that the circular aspirator cavity 314 is defined by the converging surfaces 310 and 318. The high velocity water jet has a drop in pressure in the nozzle 302 and cavity 314 as it passes therethrough resulting in a region of low pressure in the aspirator cavity 314 creating a suction zone into which the beverage concentrate, such as orange juice concentrate for example, is siphoned into the itermediate neck portion 324 of the water-concentrate flow or mixing tube 320. The mixture exits the neck portion at 327 and enters the downstream diverging or flared portion 326 where its velocity is decreased providing a substantially constant or preset mixture having a "rich" water to beverage or juice concentrate ratio. As a typical example for an orange juice concentrate and water mixture with a water pressure of about 50 psi will produce a RICH mixture having a water to juice concentrate ratio of about one and a half to one (1.5:1).

In the preferred form the diverging angle of the water-juice flow tube flared section 326 is about 3°, while the diameter of the neck portion 324 is about 0.135 inches or of the order of twice the diameter of the nozzle ring outlet 310 which has a diameter of about 0.0687 inches.

It was determined in testing the single jet pump aspirator embodiment of FIG. 13 that turbulence inducing baffle means are required downstream of the flared section 326 in the right-angled spout member 330 to insure that the concentrate-water mixture exiting the diverging section at 328 completely fills and seals the flared tube exit 328, thereby preventing air being drawn through the spout orifice 329 of spout member 330 and thence into the diverging portion 326 via spout diverging cone section 333 and right angled elbow passage 331. In the preferred form the spout 330 includes baffle means in the form of a forwardly extending arcuate trough or lip 332 at exit 328 providing an extension of the lower half of diverging portion 328. The spout tubular coupling portion 334 includes a counterbored sleeve 335 that telescopes over the outer constant diameter cylindrical portion 336 of the mixing tube 320 in a press fit sealed manner. It will be noted that the arcuate trough functions both to create turbulence of the exiting concentrate-water mixture in the spout elbow 331 and to substantially reduce the cross-sectional area of the spout vertical passage at restriction region 338 and thereby divert any air that enters spout section 333 into the turbulent area 331 thereby preventing the entrance of air into the tube diverging portion 326.

As best seen in FIG. 16, means are provided to removably secure the spout member 330 for ready removal to allow the spout to be cleaned by the housewife while insuring that it will be positively secured in proper alignment upon its replacement. To achieve this the spout member 330 has a pair of opposed U-shaped slots on either side of its coupling portion 334 with the right side slot being shown at 340 while the left side slot is indicated in hidden dashed lines at 342 in FIG. 13. Each of the slots are provided with upper and lower opposed tabs, such as the tabs 344 and 346 for slot 340, which tabs snap over circuit embossment 348 on the right side of the mixing tube member 320 while the snap tabs of slot 342 engage cross over tube portion 350 on the left side of the mixing tube. It will be noted that while the cross over tube 350 and its passageway 352 for the bypass diluting water of the embodiment of FIGS. 13—16 is an integral member as contrasted with the transverse stem 268 and telescoping boss 270 arrangement shown in the embodiment of FIG. 3, the water bypass dilution control valve 250' remains the same for both forms of the invention.

The bypass dilution water control tube for the left hand dispenser shown at 244' in FIG. 14 has aligned longitudinal bypass passageways which are mirror images of passageways 240 and 246 of FIG. 3 so as to be parallel with the nozzle passage 160' to provide a second water exit from a common source, namely the valve chamber 77'. The left hand diluting water control tube has its passageway provided with a countersunk bore for the telescopic reception of dilution control valve 250', having an inner stem substantially the same as stem 251 of FIG. 3, received in its bore and an outer dilution control knob 252' for rotation of the left hand stem relative to the control tube 244'. The left hand control stem has an outer annular groove for the retention of a retainer spring 256' to allow for the removal and cleaning of member 250'.

As explained above, the left hand control knob 286 is operated to control the left hand water dilution control valve 250' in the same manner as the right hand control knob. Thus, when the knob 286 is rotated in a counterclockwise direction to change from a RICH to MILD water to beverage concentrate mixture the bypass passageway valve stem is rotated to its fully open position wherein the total flow in the left hand bypass passageway is allowed to enter the cross over tube passageway 352 to dilute the fixed ratio of water to concentrate flowing through flared tube 326 to its maximum dilution. As a typical example of a maximum dilution for an orange juice concentrate and with a water pressure of about 50 psi will produce a MILD mixture having a water to juice concentrate ratio of about sixteen to one (16:1). It will be seen that when diluting water is being added via the bypass passage 352 the turbulence created in the elbow region 331 with the assistance of the arcuate trough-shaped baffle 332 will insure proper mixing of the bypass water with the initial substantially constant rich juice-water mixture prior to its being dispensed by the spout orifice 329 into the glass 224.

While the embodiment of the present invention as herein disclosed constitutes a preferred form, it is to be understood that other forms might be adopted.

We claim:

1. In a beverage concentrate dispenser, a discharge valve casing including a valve chamber having an inlet for connection to a source of water supply under pressure, a nozzle passage extending from said valve chamber and communicating with a mixing tube, said mixing tube having a first enlarged bore joined to a second reduced downstream bore by means of a tapered throat section, said first enlarged bore having enclosed therein in axially aligned fashion a primary Venturi nozzle whereby the flow from said nozzle passage may enter said Venturi nozzle, a beverage concentrate feed tube in communication with said enlarged bore, said primary Venturi nozzle having the downstream portion of its outer peripheral surface reduced in diameter relative to said first enlarged bore, a secondary straight jet nozzle disposed in spaced relation within said enlarged bore and coaxial with said primary Venturi nozzle and downstream therefrom, said secondary straight jet nozzle having its outer peripheral surface generated in the shape of a cone converging toward its downstream exit orifice, said secondary nozzle outer surface being reduced in diameter relative to said first enlarged bore whereby an annular flow channel in the form of one-half of a cone section is defined therebetween, said primary Venturi nozzle having its downstream end telescoped in spaced relation within the entrance of said secondary nozzle defining a first stage beverage concentrate aspirator in communication with said concentrate feed tube, whereby a first stage primary mixing of concentrate and water is achieved in the passage of said secondary jet nozzle, said secondary jet nozzle having its exit orifice located in the annular area of said tapered throat section thereby forming a second stage concentrate aspirator in conjunction with said jet nozzle which is in communication with said concentrate feed tube via said annular flow channel, such that a secondary mix of concentrate with said primary water-concentrate mix is achieved in said second reduced downstream bore for dispensing the beverage into a container from the exit of said second reduced bore.

2. In a beverage concentrate dispenser, a discharge valve casing including a valve chamber having an inlet for connection to a source of water supply under pressure, a mixing water passage extending from a first exit in said valve chamber terminating in a jet pump aspirator, said aspirator including a nozzle section having an initial downstream converging conical portion and a cylindrical ring outlet portion, said nozzle outlet exiting into an enlarged pump cavity, a vertical beverage concentrate feed tube communicating with a bottom opening in said pump cavity, said aspirator including a mixing tube section disposed in axially spaced downstream relation to said nozzle outlet, said mixing tube section having a converging cone entrance portion and a downstream diverging portion interconnected by a cylindrical neck portion whereby said nozzle is adapted to feed a jet of water to said mixing tube entrance portion creating a low pressure suction region in said pump cavity for drawing up concentrate from said feed tube and into said mixing tube entrance portion, a dilution water by-pass passageway including a tube extending from a second exit in said valve chamber in generally parallel relation with said mixing water passage, passage means connecting a downstream portion of said by-pass passageway with said mixing tube diverging portion, valve means in said by-pass passageway permitting a selected quantity of diluting water to pass through said by-pass passageway into said mixing tube diverging portion whereby the beverage concentrate-water mixture exiting said mixing tube neck portion may be diluted without substantially affecting the low pressure region created in said pump cavity.

3. In a beverage concentrate dispenser, a discharge valve casing including a valve chamber having an inlet for connection to a source of water supply under pressure, a mixing water passage extending from a first exit in said valve chamber terminating in a jet pump aspirator, said aspirator including a nozzle section having an initial downstream converging conical portion and a cylindrical ring outlet portion interconnected by an inwardly curved portion, said nozzle outlet exiting into an enlarged pump cavity surrounding said nozzle, a vertical beverage concentrate feed tube communicating with a bottom opening in said pump cavity, said aspirator including a mixing tube section disposed in axially spaced downstream relation to said nozzle outlet, said mixing tube section having a converging cone entrance portion and a downstream diverging portion interconnected by a cylindrical neck portion whereby said nozzle is adapted to feed a jet of water to said mixing tube entrance portion creating a low pressure suction region in said pump cavity for drawing up concentrate from said feed tube into said entrance portion, a dilution water by-pass passageway including a tube extending from a second exit in said valve chamber in generally parallel relation with said mixing water passage, passage means connecting a downstream portion of said by-pass passageway with said mixing tube diverging portion, valve means in said by-pass passageway permitting a selected quantity of diluting water to pass through said by-pass passageway into said mixing tube diverging portion whereby the beverage concentrate-water mixture exiting said mixing tube neck portion may be diluted without substantially affecting the low pressure region created in said pump cavity by said mixing water, a right-angled spout passage communicating with the exit of said mixing tube diverging portion, said spout including baffle means in the form of an arcuate trough extending forwardly from the lower half of said mixing tube exit a predetermined distance, said trough defining a restricted region in the vertical portion of said spout passage, whereby air entering said spout exit is prevented from entering said mixing tube diverging portion by the beverage concentrate-water mixture turbulence created in said spout passage.

4. In a beverage concentrate dispenser adapted to dispense a selected water concentrate mixture from any one of a plurality of dispensing spouts, a discharge valve casing including a valve chamber associated with each said spout, each of said valve chambers communicating via water-concentrate mixing aspirator means with its associated spout, each said valve chamber having a tubular stem extending therein connected to a common water supply manifold pipe communicating with a source of water supply under pressure, each said valve chamber stem having a seat, each said valve chamber having a valve control member seated on said stem preventing the inlet flow of water from said manifold pipe to said valve chamber, said valve control member including means for resiliently biasing the valve control member away from said valve chamber stem seat permitting the inlet flow of water from said manifold pipe into said valve chamber, an actuator assembly for each said valve chamber operative to regulate the opening and closing of its associated valve control member, each said actuator assembly including resilient spring means for maintaining the valve control member in closed sealed contact with its valve chamber stem seat, said actuator assembly including camming means thereon operative when moved to relieve the force exerted by said spring means on said valve control member whereby it is free to move to its resiliently biased position and thereby permit the flow of water from the pressure source into the valve chamber, a switch actuating shaft extending transversely across said dispenser casing and supported thereby for rotational movement about its own axis, said switch actuating shaft formed with a plurality of spaced radially directed tabs providing one tab for each actuator assembly, each of said tabs positioned in an aligned elongated opening in its associated actuator, said switch actuating shaft including a finger member positioned thereon adjacent probe means of a normally opened electrical switch, circuit means connecting said switch to a solenoid actuated water line valve controlling the flow of water from the pressurized source into said manifold pipe, the cam means of the selected concentrate mixture actuator operative when moved to initially permit the valve control member to move to its biased upper position, the selected actuator assembly operative upon further movement pivoting said actuating shaft finger into engagement with said probe means closing said electrical switch and energizing said solenoid valve thereby allowing the flow of pressurized water into the opened valve chamber.

5. In a beverage concentrate dispenser adapted to dispense a selected water concentrate mixture into any one of a plurality of dispensing spouts, a discharge valve casing including a valve chamber associated with each spout, each of said valve chambers communicating via water-concentrate mixing aspirator means with its associated spout, each said valve chamber having a tubular stem extending therein connected to a common water supply manifold pipe communicating with a source of water supply under pressure, each said valve chamber stem having a seat, each said valve chamber having a valve control member seated on said stem preventing the inlet flow of water from said manifold pipe to said valve chamber, said valve control member including means for resiliently biasing the valve control member away from said valve chamber stem seat permitting the inlet flow of water from said manifold pipe into said valve chamber, a slide actuator assembly for each said valve chamber operative to regulate the opening and closing of its associated valve control member, each said slide assembly including resilient spring means for maintaining the valve control member in closed sealed contact with its valve chamber stem seat, said slide actuator assembly including a reciprocal outwardly biased slide having camming means thereon operative when moved inwardly to relieve the force exerted by said spring means on said valve control member whereby it is free to move to its resiliently biased position and thereby permit the flow of water from the pressure source into the valve chamber, a switch actuating shaft extending transversely across said dispenser casing and supported thereby for rotational movement about its own axis, said switch actuating shaft formed with a plurality of spaced radially directed tabs providing one one tab for each slide actuator assembly; each of said tabs positioned in an aligned elongated opening in the associated slide, said switch actuating shaft including a finger member positioned thereon adjacent probe means of a normally opened electrical switch, circuit means connecting said switch to a solenoid actuated water line valve controlling the flow of water from the pressurized source into said manifold pipe, the slide cam means of the selected concentrate mixture slide operative when moved inwardly to initially permit the valve control member to move to its biased upper position, the selected slide operative upon further inward movement pivoting said actuating shaft finger into engagement with said probe means closing said electrical switch and energizing said solenoid valve thereby allowing the flow of pressurized water into the opened valve chamber.

6. In a beverage concentrate dispenser adapted to dispense a selected water concentrate mixture from any one of a plurality of dispensing spouts, a discharge valve casing including a valve chamber associated with each said spout, each of said valve chambers communicating via water-concentrate mixing aspirator means with its associated spout, each said valve chamber having a vertical tubular stem extending therein connected to a common water supply manifold pipe communicating with a source of water supply under pressure, each said valve chamber stem having a seat, each said valve chamber having a resilient valve control member seated on said stem preventing the inlet flow of water from said manifold pipe to said valve chamber, said valve control member including resilient means integral therewith for resiliently biasing the valve control member upwardly away from said valve chamber stem seat permitting the inlet flow of water from said manifold pipe into said valve chamber, a slide actuator assembly for each said valve chamber operative to regulate the opening and closing of its associated valve control member, each said slide assembly including a resilient leaf spring for maintaining the valve control member in normally sealed contact with its valve chamber stem seat, said slide actuator assembly including a reciprocal outwardly biased slide having a camming wedge on its inward and operative when moved inwardly by an operator to flex said leaf spring upwardly thereby relieving the force exerted by said leaf spring on said valve control member whereby said member is free to move to its resiliently biased position and thereby permit the flow of water from the pressure source into the valve chamber, said leaf spring operative by means of contact with said camming wedge to bias said slide actuator to its outer position upon removal of pressure by the operator, a switch actuating shaft extending transversely across said dispenser casing and supported thereby for rotational movement about its own axis, said switch actuating shaft formed with a plurality of spaced radially directed tabs providing one tab for each slide actuator, each of said tabs positioned in an aligned elongated opening in its associated slide, said switch actuating shaft including a finger member positioned thereon adjacent probe means of a normally opened electrical switch, circuit means connecting said switch to a solenoid actuated water line valve controlling the flow of water from the pressurized source into said manifold pipe, the slide cam means of the selected concentrate mixture slide operative when moved inwardly to initially cam said leaf spring upwardly permitting said valve control member to move to its biased upper position, the selected slide operative upon further inward movement pivoting its associated tab and said actuating shaft finger into engagement with said probe means closing said electrical switch and energizing said solenoid valve thereby allowing the flow of pressurized water into the opened valve chamber.

* * * * *

UNITED STATES PATENT OFFICE

CERTIFICATE OF CORRECTION

Patent No. 3,949,903 Dated April 13, 1976

Inventor(s) Louis D. Benasutti et al.

It is certified that error appears in the above-identified patent and that said Letters Patent are hereby corrected as shown below:

Column 2, line 47, "2" should read -- 3 --.

Column 4, line 39, "supon" should read -- upon --.

Column 4, line 39, after "spring" "112" should read -- 122 --.

Column 8, line 4, "94" should read -- 92' --.

Column 8, line 27, "94'", first occurrence, should read -- 92' --.

Column 9, line 24, "310" should read -- 319 --.

Column 9, line 30, "itermediate" should read -- intermediate --.

Column 10, line 16, "circuit" should read -- circular --.

Column 13, line 31, "into" should read -- from --.

Column 13, line 64, delete "one", second occurrence.

Column 13, line 66, "the" should read -- its --.

Column 14, line 39, "and" should read -- end --.

Signed and Sealed this

Nineteenth Day of October 1976

[SEAL]

*Attest:*

RUTH C. MASON
*Attesting Officer*

C. MARSHALL DANN
*Commissioner of Patents and Trademarks*